US008028426B1

(12) United States Patent
Tofani

(10) Patent No.: US 8,028,426 B1
(45) Date of Patent: Oct. 4, 2011

(54) COLLISION TOOL

(76) Inventor: Ernest F. Tofani, Riio Rico, AZ (US)

( * ) Notice: Subject to any disclaimer, the term of this patent is extended or adjusted under 35 U.S.C. 154(b) by 187 days.

(21) Appl. No.: 12/460,082

(22) Filed: Jul. 15, 2009

(51) Int. Cl.
*B43L 13/02* (2006.01)
*B43K 27/00* (2006.01)

(52) U.S. Cl. ..... 33/41.4; 33/18.1; 33/41.1; 33/44; 401/35; 401/48; 446/146

(58) Field of Classification Search ..... 33/18.1, 33/18.2, 32.1, 32.3, 34, 35, 39.2, 41.1, 41.4, 33/1 SB, 578, 579, 669; 401/34, 35, 48, 401/6, 131, 195; 101/327–331, 333, 405, 101/406
See application file for complete search history.

(56) References Cited

U.S. PATENT DOCUMENTS 158,014 A * 12/1874 Baldwin ..... 101/171
724,687 A * 4/1903 Floren ..... 401/48
2,299,242 A * 10/1942 Lui ..... 101/328
2,861,343 A * 11/1958 Click ..... 33/41.1
2,947,084 A * 8/1960 Billings ..... 33/32.2
3,762,054 A * 10/1973 Ballard ..... 33/41.4
3,858,986 A * 1/1975 Gilbert ..... 401/34
4,299,031 A 11/1981 Collins et al.
4,455,750 A * 6/1984 Sturz ..... 33/43
4,621,429 A * 11/1986 Alm ..... 33/18.1
4,680,864 A * 7/1987 Heagerty ..... 33/26
4,815,212 A 3/1989 Wood
5,116,153 A * 5/1992 Tully ..... 401/35
5,658,002 A * 8/1997 Szot ..... 280/304.1
6,351,893 B1 3/2002 Pierre
6,951,375 B2 10/2005 Patton et al.

* cited by examiner

*Primary Examiner* — Amy Cohen Johnson

(74) *Attorney, Agent, or Firm* — Patent & Trademark Services; Joseph H. McGlynn

(57) ABSTRACT

A tool which has an easily identifiable marker for each tire on a vehicle. The tool will trace the path of each tire and allow an investigator to accurately produce a drawing to recreate the path of vehicles involved in accidents.

4 Claims, 2 Drawing Sheets

COLLISION TOOL

BACKGROUND OF THE INVENTION

This invention relates, in general, to a drawing tool, and, in particular, to a drawing to which aids vehicle accident investigators.

DESCRIPTION OF THE PRIOR ART

In the prior art various types of devices have been proposed. For example, U.S. Pat. No. 4,815,212 to Wood discloses a block having four spring driven pencil leads which represent different tires on an accident vehicle U.S. Pat. No. 4,299,031 to Collins et al discloses a plotter having four different colors mounted in a plotting device.

U.S. Pat. No. 6,351,893 to Pierre discloses a template for diagramming accidents having a plurality of different shapes punched out of a single piece of plastic.

U.S. Pat. No. 6,951,375 to Patton et al discloses an apparatus for printing an image on a large surface area using colors.

Upon arrival at a collision scene where a vehicle(s) have gone out of control prior to their final resting position, or looking over photographs of skid marks that have crossed each other, it is often difficult determining the path of travel of a vehicle. An investigator often has to look a damage or paint transfers to fixtures or vehicles, tire scuff marks location of gouges, vehicle debris and the final location of the vehicles to determine the occurrence of events.

Many times, due to the complexity of tire marks crossing each other an investigator spend hours trying to reconstruct the path of a vehicle involved in an accident. Even after a diagram is drawn, an investigator has to tediously attempt to follow a confusing jumble of lines to determine the exact path of a vehicle.

The present invention is a multi purpose tool which can be used to accurately and quickly determine a vehicle's path after an accident.

SUMMARY OF THE INVENTION

The present invention is directed to a tool which has an easily identifiable marker for each tire on a vehicle. The tool will trace the path of each tire and allow an investigator to accurately produce a drawing to recreate the tire path of vehicles involved in accidents.

It is an object of the present invention to provide a new and improved tool for accident investigators.

It is an object of the present invention to provide a new and improved tool that can accurately and quickly provide an accident scene drawing.

It is an object of the present invention to provide a new and improved tool that can present a clear drawing of an accident scene These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
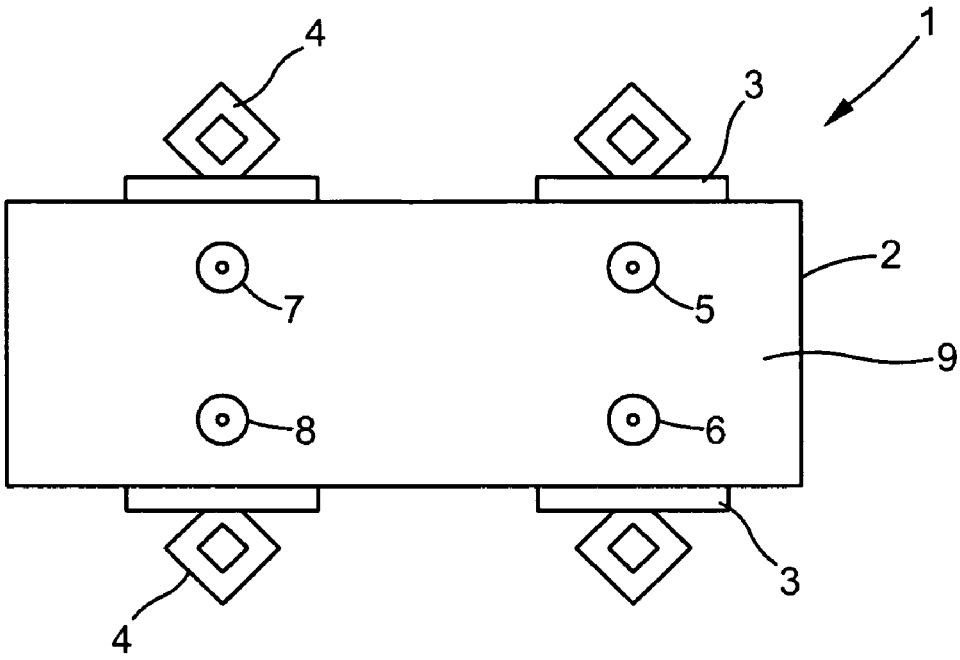
FIG. 1 is a bottom view of the present invention.

Referring now to the drawings in greater detail, FIG. 1 shows the bottom of the present invention 1. The invention has a body or a block 2 with a bottom 9. The block 2 has four wheels 3 rotatably mounted to the sides of the block. The wheels are shown in FIG. 1 to be attached by eyehooks 4 however, other mechanical means can be used without departing from the scope of the invention. Four apertures 17 are formed in the block from the top of the block to the bottom 9 and they will receive four markers 5, 6, 7, 8.

Figure 2:
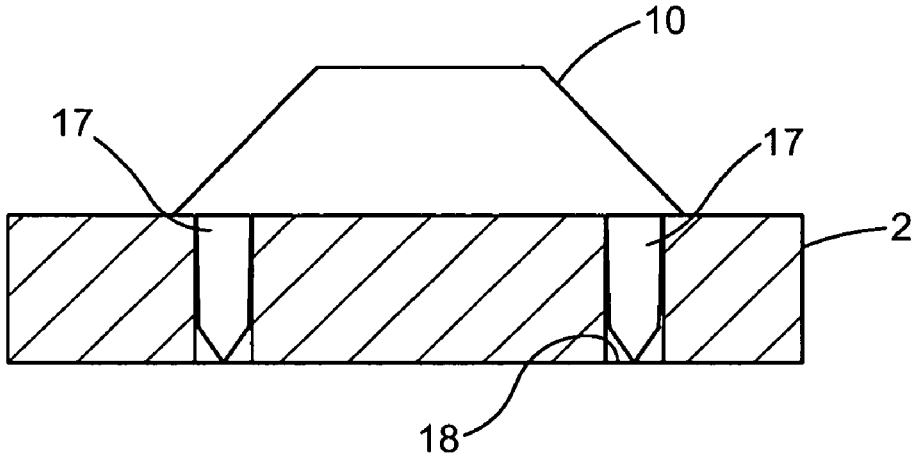
FIG. 2 is a partial cross-section of a side view of the present invention.

As shown in FIG. 2, the apertures 17 are formed to taper near the bottom of the apertures at 18 to prevent the markers 5, 6, 7, 8 from coming through the bottom. A roof 10 can be applied to the top of the block 2 to orient the user. Each of the markers are a different color. While the specific colors can be arbitrary it would be convenient if specific colors were always used for each wheel. This would always mark the drawings made with the invention with the same color for each wheel and avoid confusion between investigators or between investigators and attorneys, court officials and others. It is preferred that red (R) be used for the right front tire, black (B) be used for the left front tire, blue (BL) be used for the left rear tire and green (G) for the right rear tire (see FIG. 4).

Figure 3:
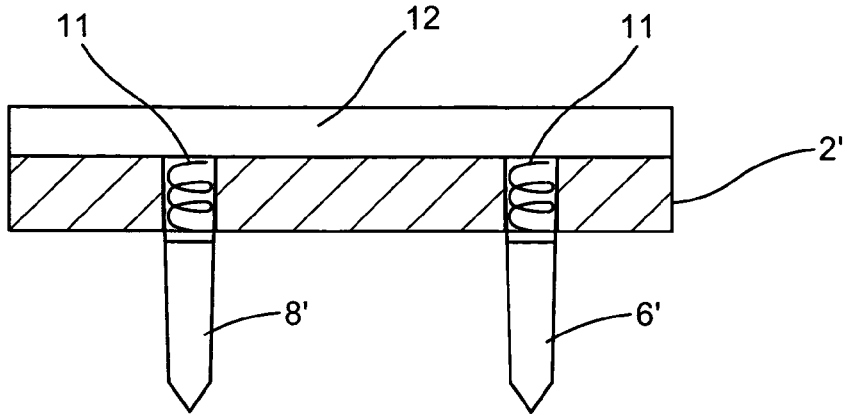
FIG. 3 is a partial cross-section of a side view of a modification of the present invention.

The markers 5, 6, 7, 8 can be held in the apertures 17 by any conventional means. For example, the eyehooks 4 can be aligned with the apertures 17 and intersect the markers when they are placed in the apertures. In this manner the eyehooks will serve as setscrews to secure the markers 5, 6, 7, 8 within the apertures. Another method is shown in FIG. 3. Here a spring 11 is inserted into the block 2' (only partially shown in FIG. 3 for clarity) on top of each marker, then a plate 12 is fastened to the top of the block to trap the screws and the markers within the block 2'. It should be noted that only markers 6', 8' are shown in FIG. 3 however, a spring would be provided for each of the four markers. The plate 12 could be attached to the block 2' by any conventional method.

Figure 4:
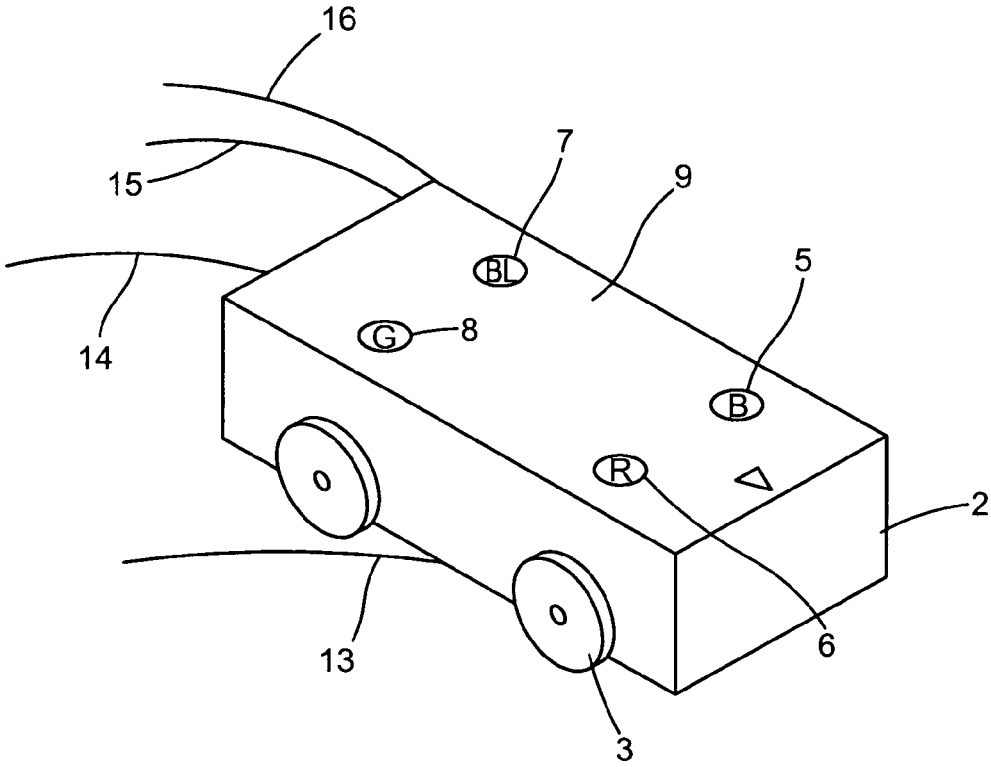
FIG. 4 is a perspective view of the present invention showing the lines drawn for each tire.

FIG. 4 shows the present invention as it would be used to mark a diagram. It should be noted that the roof has been removed for clarity and each of the markers has been marked with a letter to show the color of the barker. R is used for red and designates the front right side tire. B is for blue and is used for the front left side tire. BL is for black and is used for the left rear side tire. G is for green and is used for the right rear side tire.

As shown in FIG. 4 the vehicle begins to lose control and is entering a clockwise rotation. Line 13 shows the path of the right front tire and is produced by marker 6 (red). Line 14 shows the path of the right rear tire and is produced by marker 8 (green). Line 15 shows the path of the left rear tire and is produced by marker 7 (black). Line 16 shows the path of the left front tire and is produced by marker 5 (blue). As the vehicle continues in a clockwise rotation its left front tire 5 and the right rear tire 14 will cross each other giving a trained investigator proper information about the motion of the vehicle. This information will allow the investigator to quickly identify what occurred and will allow him to make an accurate report. This would be much more difficult if the different colors were not used for the individual tires Although the Collision Tool and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A collision tool for use by investigators, said tool comprising:

a body, said body having a length, width, top and bottom, said body also having sides, said sides extending between said top and said bottom, four through apertures extending from said top of said body through the bottom of said body, a marker fixed within each of said four through apertures, each said marker having a lower point that extends below the bottom of said body, each one of said markers producing a different color, and means for fixing said markers within said four through apertures which comprise fasteners extending through said sides of said body, and wherein said body has a plurality of tires attached to said sides of said body, and each said marker is mounted between said sides and aligned with one of said tires.

2. The collision tool as claimed in claim 1, wherein a red marker is aligned with a tire at a right front side of said body, a black marker is aligned with a tire at a left front side of said body, a blue marker is aligned with a tire at a right back side of said body, and a green marker is aligned with a tire at a right back side of said body.

3. A collision tool for use by investigators, said tool comprising:

a body, said body having a length, width, top and bottom, said body also having sides, said sides extending from said top to said bottom, four through apertures extending from said top of said body through the bottom of said body, a marker fixed within each of said four through apertures, each said marker having a lower point that extends below the bottom of said body, each one of said markers producing a different color, and means for fixing said markers within said four through apertures, and wherein said means for fixing said markers within said four through apertures further comprises resilient means for pressing said markers toward said bottom of said body, and wherein said means for fixing said markers within said four through apertures further comprises tapered portions of said four through apertures, and, said resilient means positioned on an upper extremity of said markers, and a plate affixed to said top of said body, said plate having an upper surface and a lower surface, said resilient means engages said lower surface of said plate.

4. The collision tool as claimed in claim 3, wherein a red marker is aligned with a tire at a right front side of said body, a black marker is aligned with a tire at a left front side of said body, a blue marker is aligned with a tire at a right back side of said body, and a green marker is aligned with a tire at a right back side of said body.

* * * * *